US006458448B1

(12) United States Patent
Hunt

(10) Patent No.: US 6,458,448 B1
(45) **Date of Patent: *Oct. 1, 2002**

(54) EDGE PROTECTOR

(75) Inventor: Raymond John Hunt, Shropshire (GB)

(73) Assignee: ITW Limited, Berkshire (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,394

(22) PCT Filed: Sep. 8, 1997

(86) PCT No.: PCT/GB97/02404

§ 371 (c)(1),
(2), (4) Date: Apr. 28, 1999

(87) PCT Pub. No.: WO98/09869

PCT Pub. Date: Mar. 12, 1998

(30) Foreign Application Priority Data

Sep. 6, 1996 (GB) ..... 9618611

(51) Int. Cl.[7] ..... B65D 81/05; B65B 25/14

(52) U.S. Cl. ..... 428/192; 428/152; 428/155; 428/156; 428/121; 428/122; 428/124; 428/126; 428/906; 428/213; 428/215; 428/130; 428/120; 428/123; 428/125; 428/127; 428/128; 428/129; 428/43; 206/586; 206/400; 206/398; 206/453; 206/413; 206/414; 206/415; 53/372.9; 53/139.7; 53/410; 493/396

(58) Field of Search ..... 53/372.9, 139.7, 53/410; 206/400, 398, 453, 586, 413, 414, 415; 428/152, 155, 156, 121, 122, 124, 126, 906, 192, 213, 215, 130, 120, 123, 125, 127, 128, 129, 43; 493/396

(56) References Cited

U.S. PATENT DOCUMENTS

| | | | | |
|---|---|---|---|---|
| 1,356,391 | A | 10/1920 | Myers | 206/59 |
| 1,697,891 | A | 1/1929 | Weichsel | 206/59 |
| 1,772,850 | A | 8/1930 | Wheldon | 206/59 |
| 1,814,968 | A | 7/1931 | Schario | 206/59 |
| 1,876,063 | A | 9/1932 | Kronenberger | 206/59 |
| 1,927,403 | A | 9/1933 | Hoffmann | 206/59 |
| 1,936,227 | A | 11/1933 | Cook | 206/59 |
| 1,989,182 | A | 1/1935 | Blake | 206/59 |
| 1,989,183 | A | 1/1935 | Blake | 206/59 |
| 2,037,609 | A | 4/1936 | Vizcaino | 229/46 |
| 2,155,312 | A | 4/1939 | Houtzaager | 18/8 |
| 2,217,397 | A | 10/1940 | Armitt | 206/52 |
| 2,266,181 | A | 12/1941 | Epps | 206/69 |
| 2,453,093 | A | 11/1948 | Jarvis | 123/117 |
| 2,655,303 | A | 10/1953 | Cox | 229/2.5 |
| 2,716,008 | A | 8/1955 | Taylor, Jr. | 242/159 |
| 3,023,885 | A | 3/1962 | Kindseth | 206/46 |
| 3,030,728 | A | 4/1962 | Wesman | 45/68.4 |

(List continued on next page.)

FOREIGN PATENT DOCUMENTS

| | | |
|---|---|---|
| GB | 243453 | 11/1925 |
| WO | WO 93/09931 | * 5/1993 |
| WO | WO94/29195 | 12/1994 |
| WO | WO97/20750 | 6/1997 |

*Primary Examiner*—William P. Watkins, III
(74) *Attorney, Agent, or Firm*—Lowe Hauptman Gilman & Berner, LLP

(57) ABSTRACT

An edge protector for the edges of roll shaped articles, e.g. pallets, reeled steel and paper products is made from an elongated sheet (10) of plastics material, the sheet having an indentation (11) extending longitudinally along a major surface of the sheet and extending only partially into the thickness of the sheet. The indentation (11) divides the sheet into webs (12, 13) which are folded into an L-shape.

21 Claims, 4 Drawing Sheets

U.S. PATENT DOCUMENTS

| | | | | | |
|---|---|---|---|---|---|
| 3,047,142 | A | | 7/1962 | Heffley | 206/62 |
| 3,049,260 | A | | 8/1962 | Stone | 217/53 |
| 3,073,439 | A | | 1/1963 | Symmonds, Jr. | 206/60 |
| 3,152,693 | A | | 10/1964 | Anderson | 206/60 |
| 3,172,617 | A | | 3/1965 | Johnson | 242/129.5 |
| 3,199,709 | A | | 8/1965 | Morrison et al. | 217/69 |
| 3,200,547 | A | | 8/1965 | Johnson | 52/288 |
| 3,292,513 | A | * | 12/1966 | Palmer | 493/396 |
| 3,332,601 | A | | 7/1967 | Frank, Jr. | 229/23 |
| 3,416,652 | A | | 12/1968 | Almasy | 206/60 |
| 3,453,695 | A | | 7/1969 | Owen | 24/22 |
| 3,633,335 | A | * | 1/1972 | Johnson | 53/380 |
| 3,637,234 | A | | 1/1972 | Thomas et al. | 280/179 A |
| 3,645,387 | A | | 2/1972 | Hunt | 206/60 |
| 3,762,626 | A | | 10/1973 | Dorsey | 229/14 C |
| 3,854,529 | A | | 12/1974 | Sagan | 165/162 |
| 3,875,617 | A | | 4/1975 | Cline | 24/16 R |
| 3,879,040 | A | | 4/1975 | Smith | 273/130 AC |
| 3,982,712 | A | | 9/1976 | Bassett | 242/129 |
| 4,008,802 | A | | 2/1977 | Freitag | 206/63.3 |
| 4,037,718 | A | | 7/1977 | Stiller | 206/53 |
| 4,082,187 | A | | 4/1978 | Carlson | 206/585 |
| 4,120,441 | A | | 10/1978 | Hurley | 206/586 |
| 4,151,913 | A | | 5/1979 | Freitag | 206/370 |
| 4,202,449 | A | | 5/1980 | Bendt | 206/453 |
| 4,244,471 | A | | 1/1981 | Plante | 206/586 |
| 4,496,049 | A | | 1/1985 | Pabodie et al. | 206/395 |
| 4,513,864 | A | | 4/1985 | Liebel | 206/396 |
| 4,526,500 | A | | 7/1985 | Patrick | 410/48 |
| 4,722,153 | A | | 2/1988 | Hardy | 52/255 |
| 4,741,126 | A | | 5/1988 | Adell | 49/462 |
| 4,742,916 | A | | 5/1988 | Galea | 206/586 |
| 4,840,274 | A | | 6/1989 | Young | 206/389 |
| 4,852,318 | A | | 8/1989 | Anderson | 52/288 |
| 4,876,837 | A | | 10/1989 | Kelly et al. | 52/287 |
| 4,877,673 | A | | 10/1989 | Eckel et al. | 428/172 |
| 5,138,810 | A | | 8/1992 | Kartler | 52/254 |
| 5,238,113 | A | | 8/1993 | Parrott et al. | 206/395 |
| D351,988 | S | | 11/1994 | Gotcher | D8/403 |

* cited by examiner

EDGE PROTECTOR

TECHNICAL FIELD

This invention relates to the protection of an edge of roll shaped articles such as coils of sheetmetal, plastics; pallets; and the like.

Edge-protectors are used in industry as packaging to protect the edges of many products, e.g. pallets and coiled steel and paper products.

BACKGROUND ART

Conventionally, edge-protectors have been made of laminated cardboard or compositions containing recycled paper and plastics materials. In their simplest configuration, they are produced as long lengths of 'L' shaped transverse cross-section, usually rigid, and are cut to length as required. They are then attached over the edges of the product to be protected and held in place by any convenient means, e.g. staples, tape or a protective finish. Edge protectors of plastic materials can also be extruded to the desired L-shaped cross-section and then cut to lengths as required.

Where the products to be protected have substantially uniform edges, the manufacture and fitting of an L-shaped protector is a relatively straightforward operation. However, problems arise when it is desired to fit edge-protectors to non-uniform edges, e.g. coiled steel or paper products. It will be appreciated that the edges of such rolled products cannot so easily be covered by a rigid or fixed angle edge-protector as the protector must be flexible to follow the curves of the product while having the ability to conform closely to both surfaces of the product that define the edge to be protected.

It is an object of the present invention, therefore, to provide improved means (either manual or automatic) for edge-protection which is particularly suitable for use in protecting the edges of generally roll shaped articles that are non-linear.

SUMMARY OF THE INVENTION

Accordingly in one aspect the invention provides a method of protecting the edge portion of an article by means of a generally L-shaped edge protector, the protector being formed from a length of plastics sheet material having an indentation extending longitudinally along a major surface of the length and extending only partially into the thickness of the length, the indentation dividing the length into web portions, the method comprising:

- locating a reel of the edge protector adjacent the article whose edge is to be protected;
- unreeling an unformed (flat) length portion of the reel and advancing it towards the article;
- passing the length portion through a former to bend one web portion relative to the other to form a generally L shape edge protector, and
- applying the L shaped edge protector with the article along the edge.

If necessary the portion of the protector in contact with the article can then be separated from the length.

Preferably the exact angle of the bend is defined by the former.

In another aspect the invention provides an edge-protector for use in a method as defined comprising an elongate sheet of plastics material, the sheet having an indentation extending longitudinally along a major surface of the sheet and extending only partially into the thickness of the sheet, the indentation dividing the sheet into two web portions, the sheet being folded about the line of the indentation into a substantially L-shaped cross-sectional shape to provide the edge protector.

It may be preferred that the indentation or cut extends along the centre line of the sheet material so that an equal width of material is provided on each side of the cut but this is not essential. The indentation preferably extends continuously for the whole length of the sheet material.

The indentation divides the sheet into two web portions. These web portions are usually referred to as the 'shoulder' and the 'leg' and for use to protect a product with a curved surface, the shoulder usually rests on the curved surface with the leg extending down the adjacent surface. Thus each web covers and protects one of the two surfaces defining the edge to be protected. We have surprisingly found that the sheet may be folded about the indentation line such that the two webs may be positioned at an angle to each other, e.g. 90°, and that they will remain in that position for a significant period of time, i.e. their recovery towards their original unfolded configuration is slow. (Although the angle between the webs is most usually about 90°, it will be appreciated that any other angle may be selected to suit the particular packaging requirements). Thus after the material has been cut to the desired length, the webs may be folded to the desired angle and then positioned over the edge to be protected and they will remain at the desired angle while the edge-protection operation is carried out and until well after the protector has been fixed in the desired position. The folding to the desired angle may be carried out manually, with mechanical resistance or fully automatically. The amount of mechanical assistance required may vary according to the depth of the indentation. It will be observed that there is no deformation on the underlying non-indented surface.

This surprising effect is not achievable by operations other than providing the indentation or cut line partially through the thickness of the sheet. Thus, for example, if significant plastic material is removed to form the line about which the edge protector is to be folded, e.g. by milling a longitudinal groove in the surface of the sheet, the effect is quite different and the folded webs cannot be maintained at the desired angle during fitting of the edge-protector without some additional restraint to prevent them returning towards the original flat configuration.

Although not wishing to be limited to any particular theory, it is believed that the advantage of the present invention in this respect is due to the deformation of the plastic material initiated by the indentation.

The plastics material is preferably polyethylene or polypropylene but any other suitable materials may be used, e.g. ethylene-propylene copolymers. Polyethylene is a particularly preferred material and although it may be of low, i.e. down to about 0.9, density or high, i.e. above about 0.95, density, it is especially preferred to use a medium density polyethylene, i.e. of density about 0.94.

The depth of the indentation required to give the desired fold and deformation properties will, of course, depend on the thickness of the sheet material, the plastics material used and the compounding ingredients used in the plastics material. Typical plastics edge protectors of the invention may be from 0.5 to 6.0 mm thick and, by way of example only, the indentation or cut may be from 10 to 60% of that thickness.

It will be appreciated that the skilled man of the art will readily be able to determine by trial and error the preferred depth to use for any particular plastics sheet material.

The edge-protectors of the present invention may conveniently, due to their flexibility, be stored and transported in reel form until such time as lengths are required to be cut from the reel for use. They are particularly advantageous for the protection of rolls, e.g. of steel or of paper, e.g. high quality photographic print paper.

In a particularly preferred embodiment, one of the two webs defined by the line of the indentation or cut is shaped or otherwise physically treated to enable it to adjust longitudinally as the edge-protector is applied to a curved edge. For example this web may be provided with diagonal cuts completely through its thickness and extending from its outer edge to the central cut line. Alternatively, this web may be formed to have a saw tooth profile, the points of the teeth being at the outer edge of the web.

In another aspect the invention provides a reel of plastics sheet material, the sheet having an indentation extending longitudinally along a major surface of the sheet and extending only partially into the thickness of the sheet, the indentation dividing the sheet into two web portions, a length of the sheet when pulled off the reel being foldable about the line of the indentation to form an edge-protector of substantially L-shaped cross section.

Where the protectors of the invention are made in configurations such as the saw-tooth arrangement discussed above, they may conveniently be made, e.g. extruded, in multi-width form and then cut longitudinally to provide lengths of separate edge-protectors. In this embodiment the sheet material may be passed beneath multiple tools to impart the cut lines in the parts of the width simultaneously or the indentation or cut line may be introduced after separation into single lengths.

The products of the invention have been found to be eminently suitable for automatic application to coiled materials by continuous automatic methods.

BRIEF DESCRIPTION OF THE DRAWING

Embodiments of the invention will now be described by way of example only with reference to the accompanying diagrammatic drawings in which.

BEST MODE FOR CARRYING OUT THE INVENTION

Figure 1:
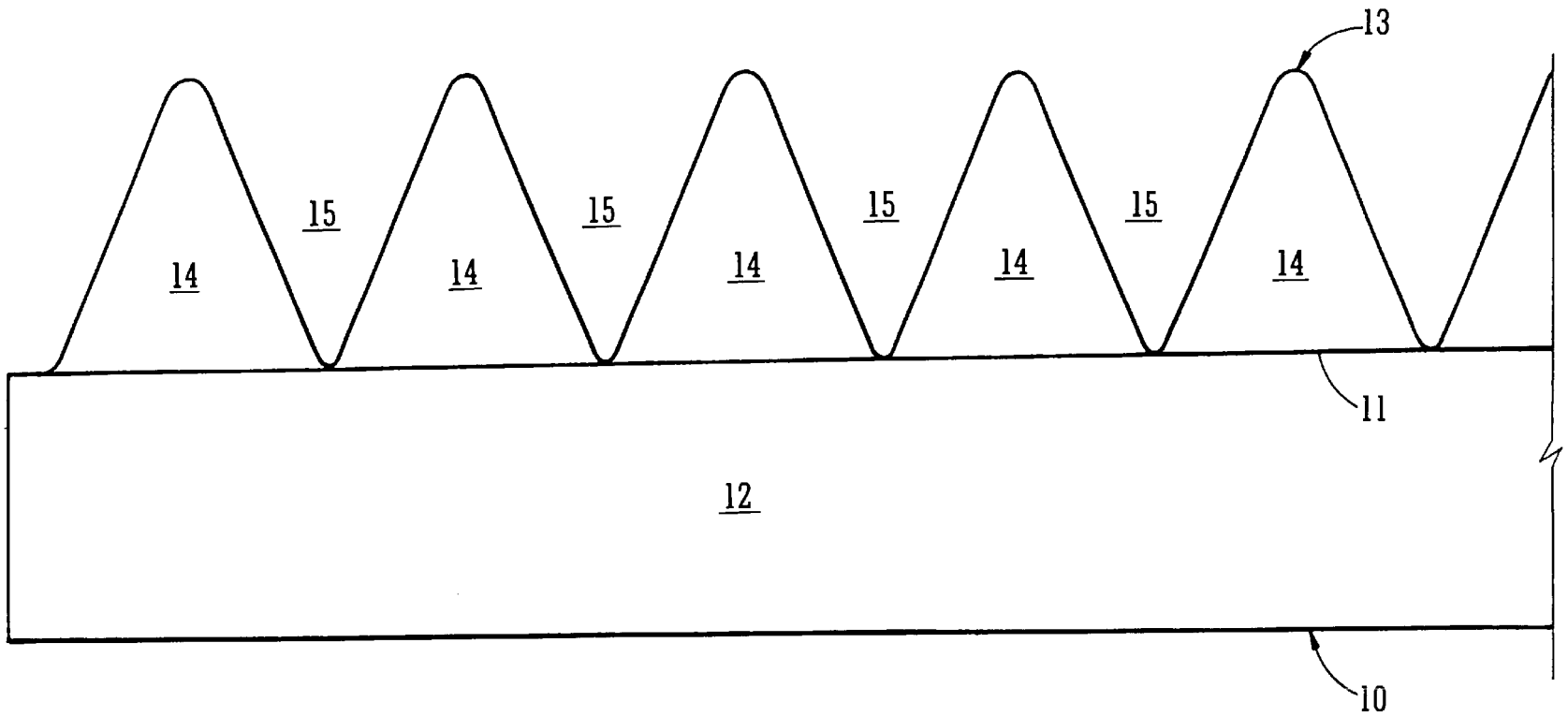
FIG. 1 is a plan view of a portion of a continuous length of an edge-protector of the invention in planar form, i.e. before folding.

In FIG. 1, a planar sheet 10 of extruded polyethylene has a longitudinally-extending, continuous indentation 11, extending only part-way, approximately 35%, into the thickness of the sheet. The underside of the sheet has no underlying deformation because the indentation does not cut through the thickness of the sheet.

Indentation 11 divides the sheet into two webs 12 and 13. Web 12 is a plain, straight-edged web while web 13 has a saw-tooth shape defined by a series of generally triangular teeth 14 defining gaps 15 between the teeth. The bases of the triangles 14 adjoin the line 11 while the points of the teeth define the outer edge of the web. These points may be angular or curved.

Figure 2:
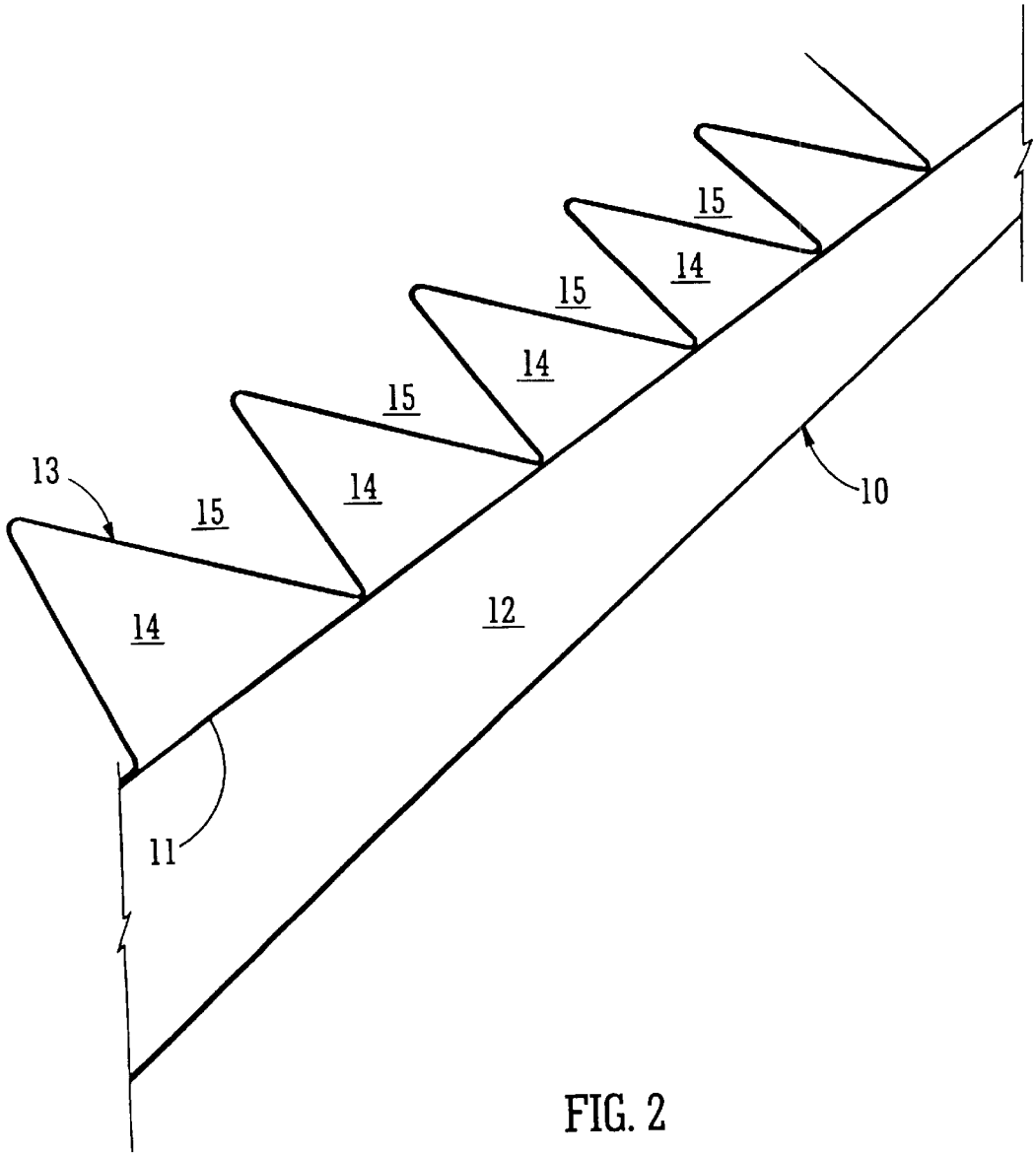
FIG. 2 is a perspective view of the formed edge protector of FIG. 1.

In FIG. 2, sheet 10 has been folded about the cut line 11 so that webs 12 and 13 lie at approximately 90° to each other and the L-shaped edge protector is formed. Having been folded to this position, the webs will retain the position for a considerable length of time and more than long enough for the edge-protector to be applied to a rolled product as shown in FIG. 3.

Figure 3:
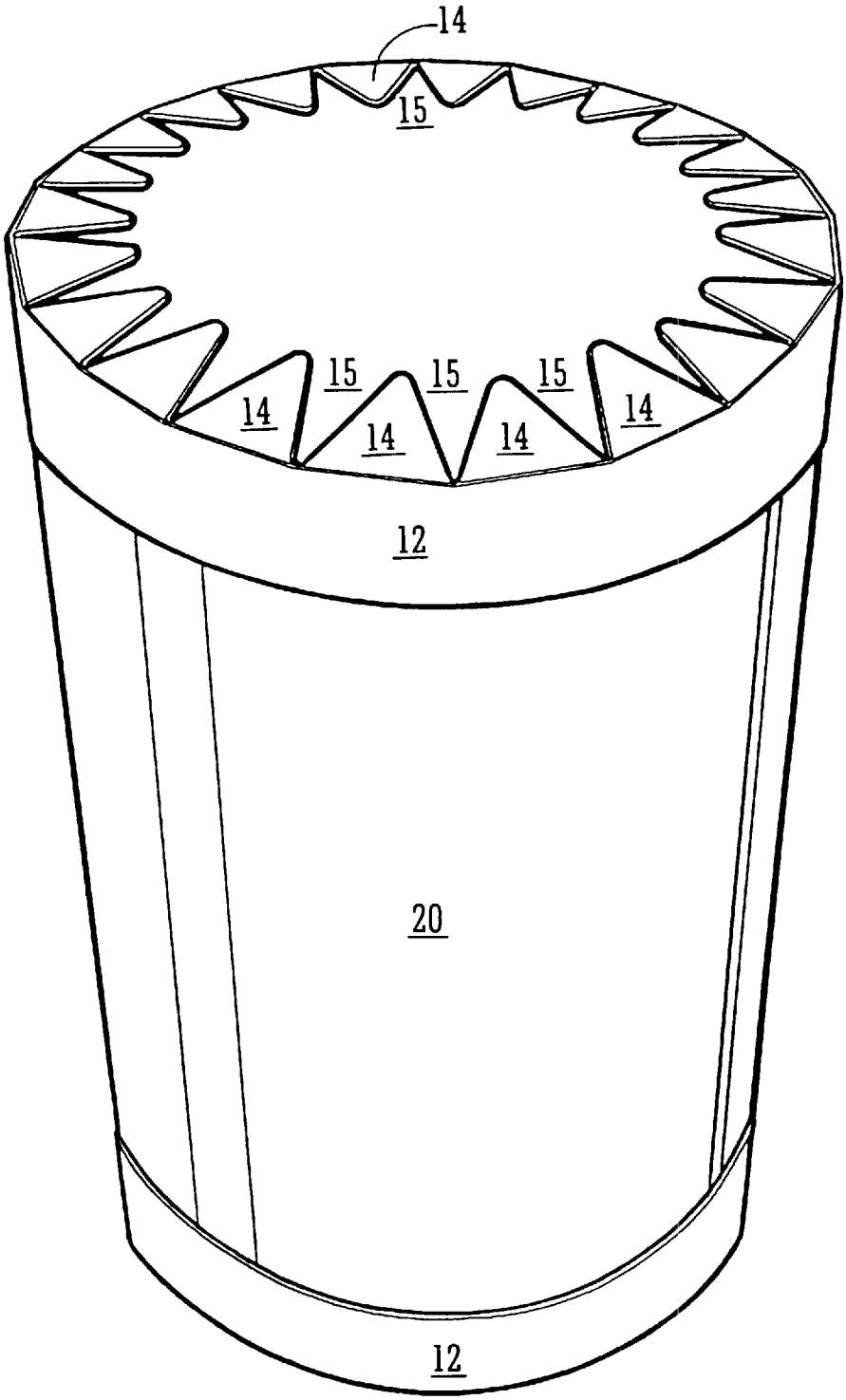
FIG. 3 is a perspective view of a rolled product, e.g. steel or paper provided with edge-protectors of the invention.

In FIG. 3, roll 20 has its upper and lower circumferences fitted with edge-protectors of the type shown in FIG. 2. It will be appreciated that as the edge-protector is curved to follow the curves of the edges of the roll 20, the gaps 15 between teeth 14 can close up to the extent necessary to cater for the amount of coming together experienced by adjacent teeth 14. It may be desirable in certain circumstances that the teeth overlap to provide extended protection and this may be accomplished with the use of a suitably varied web profile.

Figure 4:
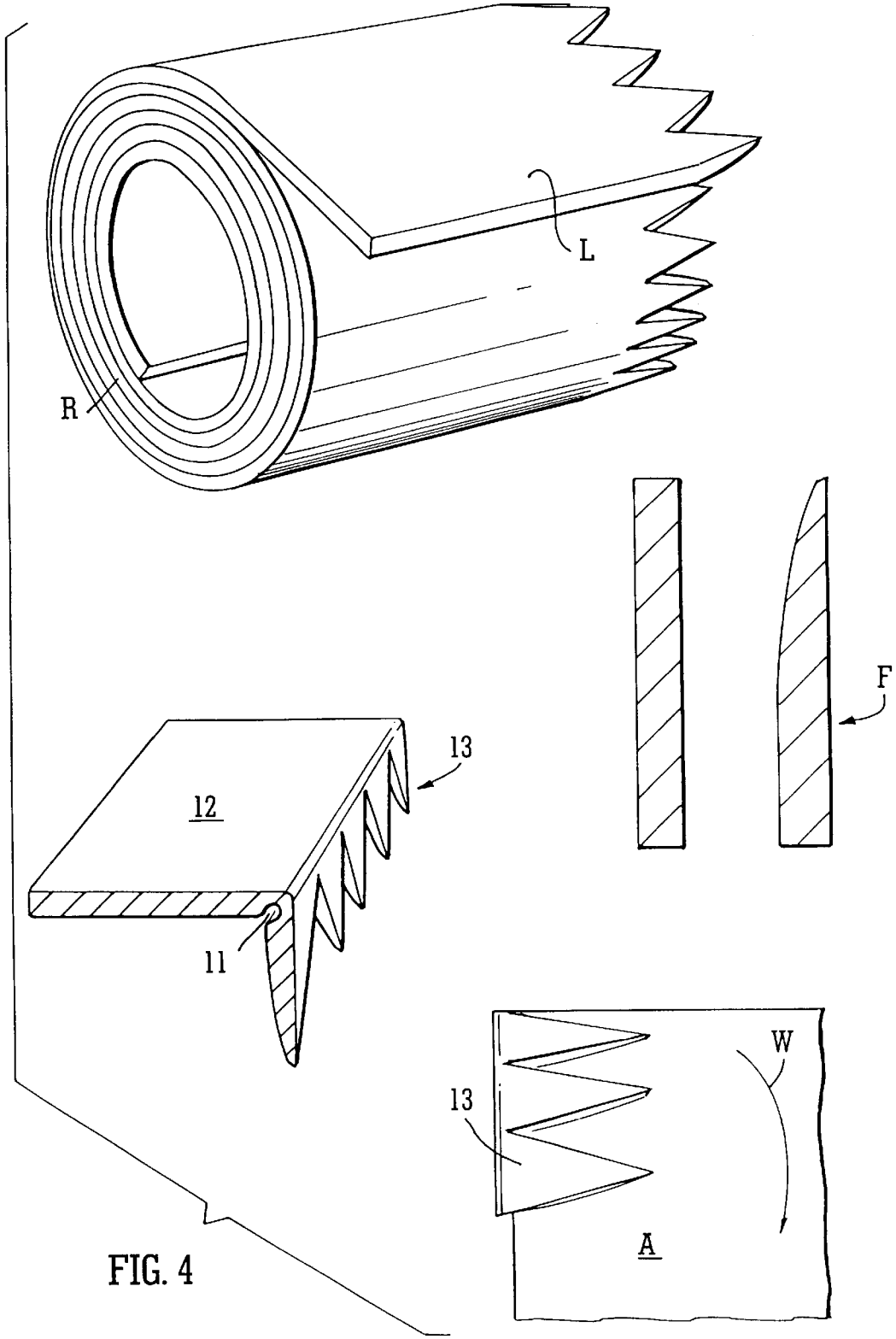
FIG. 4 illustrates schematically one sequence of forming and applying an edge protector of the invention to a roll shaped article.

As shown in FIG. 4 a length of the sheet shown in FIG. 1 has been reeled into a reel R. Because the sheet is substantially planar it is possible to reel the length tightly without any risk of distortion. The reel R is then transported to the site of use and located adjacent the article having an edge to be protected. The leading end length L of the reel is unwound and passed by pushing or pulling into a forming station F having internal walls constructed to cause the web 13 to hinge about the indentation 11 so that the length assumes a generally L cross-sectional shape as shown. (As a practical matter the internal wall of the former may be dimensioned to urge the web through more than 90° and then allow it to relax to the 90° position with respect to the web 12). The edge protector so formed is then advanced to the station having the article A whose edge is to be protected. Typically that article will be rotated in the direction of arrow W while it is being wrapped. A sensing device, not shown, contacts the leading edge of the edge protector with the corner of the article and the edge protector is then wound in synchronism with the article so as to cover the edge. When sufficient edge protector has been wound on the excess length is then trimmed or cut away. Because of the resilience. of the material the edge protector will stay in place and there has been no wastage.

In one specific use, reels R are transported to a site of use. The reels are then located adjacent to or on a steel coil receiving station. The free end of the coiled strip is released and drawn down to the steel coil, still with the sheet in generally planar form. Immediately near the coil the strip enters the former and is formed into generally the L-shape. The shaped edge protector is brought into contact with an edge of the coil. It is then advanced, preferably pulled on the coil, and wrapped about the coil preferably at the same time. The length is then trimmed. The process is performed on both sides of the coil. The method is performed without human intervention using proximity switches and like sensors to detect and control the various stages.

The product to be protected need not be of roll form.

I clam:

1. A method of protecting the edge portion of an article by means of a generally L-shaped edge protector, the protector being formed from a length of plastics sheet material having an indentation extending longitudinally along a major surface of the length and extending only partially into the thickness of the length whereby there is no deformation of the opposite major surface, the indentation dividing the length into web portions, the method comprising:

locating a reel of the edge protector adjacent the article whose edge is to be protected;

unreeling an unformed (flat) length portion of the reel and advancing it towards the article;

passing the length portion through a former to bend one web portion relative to the other to form a generally L-shape edge protector; and applying an L-shaped edge protector along the edge of the article;

wherein the thickness defined by the major surfaces of the edge protector in one of the web portions tapers toward a free edge of said web portion, away from the indentation.

2. method of claim 1, wherein, in said web portion, one of the major surfaces is curved while the other major surface is substantially planar.

3. The method of claim 2, wherein the major surface which is formed with the indentation is curved.

4. The method of claim 1, wherein said web portion has a plurality of cut-outs, which extend completely through a thickness of said web portion and from the free edge thereof toward the indentation, to have a saw-tooth profile.

5. The method of claim 4, wherein teeth of said saw-tooth profiled web portion overlap in the L-shaped edge protector.

6. An edge-protector, comprising an elongate sheet of plastics material, the sheet having an indentation extending longitudinally along a major surface of the sheet and extending only partially into the thickness of the sheet, whereby there is no deformation of the opposite major surface, the indentation dividing the sheet into two web portions, the sheet being folded about the line of the indentation into a substantially L-shaped cross-sectional shape to provide the edge-protector;

wherein the thickness defined by the major surfaces of the edge protector in one of the web portions tapers toward a free edge of said web portion, away from the indentation.

7. The edge protector of claim 6, wherein, in said web portion, one of the major surfaces is curved while the other major surface is substantially planar.

8. The edge protector of claim 7, wherein the major surface which is formed with the indentation is curved.

9. The edge protector of claim 6, wherein said web portion has a plurality of cut-outs, which extend completely through a thickness of said web portion and from the free edge thereof toward the indentation, to have a saw-tooth profile.

10. The edge protector of claim 9, wherein teeth of said saw-tooth profiled web portion overlap in the L-shaped edge protector.

11. The edge protector of claim 6, wherein the indentation is a cut line formed without removing material from the edge protector.

12. The edge protector of claim 6, wherein the indentation has a curved cross-sectional shape in the L-shaped edge protector.

13. A reel of plastics sheet material, the sheet having an indentation extending longitudinally along a major surface of the sheet and extending only partially into the thickness of the sheet, whereby there is no, deformation of the opposite major surface, the indentation dividing the sheet into two web portions, a length of the sheet when pulled off the reel being foldable about the line of the indentation to form an edge-protector of substantially L-shaped cross section;

wherein the thickness defined by the major surfaces of the sheet in one of the web portions tapers toward a free edge of said web portion, away from the indentation.

14. The reel of claim 13, wherein, in said web portion, one of the major surfaces is curved while the other major surface is substantially planar.

15. The reel of claim 14, wherein the major surface which is formed with the indentation is curved.

16. The reel of claim 13, wherein said web portion has a plurality of cut-outs, which extend completely through a thickness of said web portion and from the free edge thereof toward the indentation to have a saw-tooth profile.

17. The reel of claim 16, wherein teeth of said saw-tooth profiled web portion overlap in the L-shaped edge protector.

18. The reel of claim 13, wherein the indentation is a cut line formed without removing material from the sheet.

19. The reel of claim 13 wherein the indentation has a curved cross-sectional shape in the L-shaped edge protector.

20. A reel of plastics sheet material, which is deformable, the sheet having an indentation extending longitudinally along a major surface of the sheet and extending only partially into the thickness of the sheet, whereby there is no deformation of the opposite major surface, the indentation dividing the sheet into two web portions, a length of the sheet when pulled off the reel being foldable about the line of the indentation to form an edge-protector of substantially L-shaped cross section, the web portions of which remain at an angle to each other for a significant period of time;

wherein the thickness defined by the major surfaces of the sheet in one of the web portions tapers toward a free edge of said web portion, away from the indentation.

21. An edge-protector for protecting an edge portion of an article, said edge-protector comprising an elongate sheet of plastics material having an indentation extending longitudinally along a major surface of a length of the sheet and extending only partially into the thickness of the length, an opposite major surface of said sheet being formed without any deformation in a region coextensive with the indentation formed in said major surface, said indentation dividing the length into web portions, said sheet being foldable about the line of the indentation into a substantially L-shaped cross-sectional shape to provide the edge-protector;

wherein the thickness defined by the major surfaces of the length of the sheet in one of the web portions tapers toward a free edge of said web portion, away from the indentation.

* * * * *